US005903141A

United States Patent [19]

Tailliet

[11] Patent Number: 5,903,141

[45] Date of Patent: May 11, 1999

[54] CURRENT REFERENCE DEVICE IN INTEGRATED CIRCUIT FORM

[75] Inventor: François Tailliet, Les Berges de la Cause, France

[73] Assignee: SGS-Thomson Microelectronics S.A., Saint Genis, France

[21] Appl. No.: 08/791,383

[22] Filed: Jan. 30, 1997

[30] Foreign Application Priority Data

Jan. 31, 1996 [FR] France ..... 96 01168
Jun. 20, 1996 [FR] France ..... 96 07705

[51] Int. Cl.[6] ..... G05F 3/04; G05F 3/16; G05F 1/10

[52] U.S. Cl. ..... 323/312; 323/315; 323/907; 327/543

[58] Field of Search ..... 323/312, 315, 323/907; 327/543

[56] References Cited

U.S. PATENT DOCUMENTS

| | | | |
|---|---|---|---|
| 4,442,398 | 4/1984 | Bertails et al. | 323/315 |
| 4,780,624 | 10/1988 | Nicollini et al. | 307/296 R |
| 4,978,904 | 12/1990 | Fitzpatrick et al. | 323/315 |
| 4,999,567 | 3/1991 | Morigami | 323/315 |
| 5,059,890 | 10/1991 | Yoshikawa et al. | 323/315 |
| 5,467,052 | 11/1995 | Tsukada | 327/543 |
| 5,512,855 | 4/1996 | Kimura | 323/312 |
| 5,587,655 | 12/1996 | Oyabe et al. | 323/312 |
| 5,644,216 | 7/1997 | Lopez et al. | 323/315 |
| 5,696,440 | 12/1997 | Harada | 323/315 |
| 5,739,682 | 4/1998 | Kay | 323/315 |

FOREIGN PATENT DOCUMENTS

| | | | |
|---|---|---|---|
| A-0 021 289 | 1/1981 | European Pat. Off. | G05F 3/20 |
| A-0 687 967 | 12/1995 | European Pat. Off. | G05F 3/30 |

*Primary Examiner*—Peter S. Wong
*Assistant Examiner*—Rajnikant B. Patel
*Attorney, Agent, or Firm*—Wolf, Greenfield & Sacks, P.C.

[57] ABSTRACT

A current reference device in integrated circuit form with a reference resistor includes a first MOS transistor and a second MOS transistor having the same type of conductivity, the first transistor having its gate and its drain connected together to a first terminal of the reference resistor, the second transistor having its gate and its drain connected together to a second terminal of the reference resistor, the first transistor having a threshold voltage greater than that of the second transistor, these two transistors being biased in saturated mode, the source of each of these transistors being biased at the same potential as the substrate or the well in which the transistor is made.

45 Claims, 2 Drawing Sheets

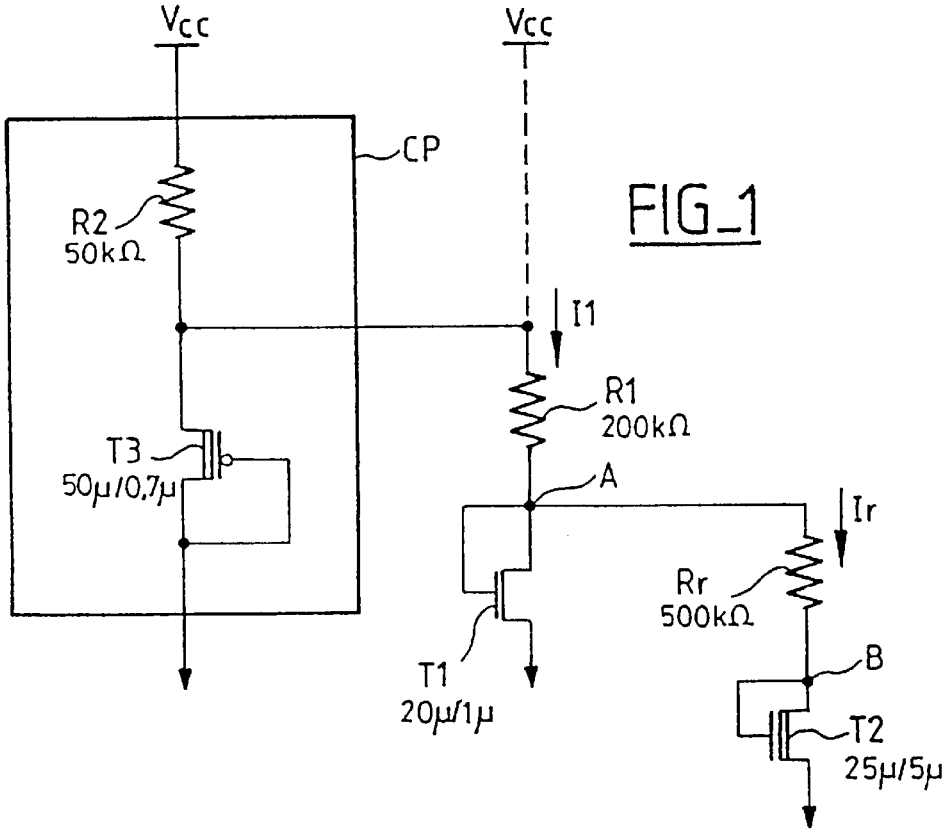
FIG_1
FIG_2
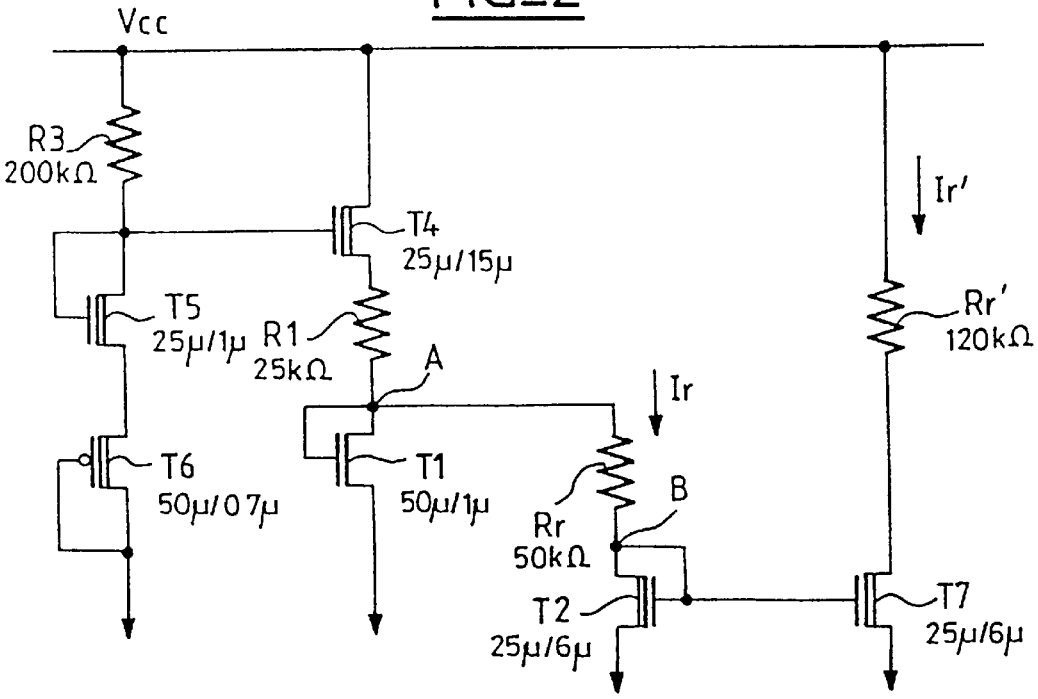

CURRENT REFERENCE DEVICE IN INTEGRATED CIRCUIT FORM

BACKGROUND OF THE INVENTION

1. Field of the Invention

The invention pertains to a stable current reference device in integrated circuit form. Devices of this kind are used especially in memory circuits, in particular to generate the stable timing signals needed for the reading or writing of the memory cells.

Current stability is a quality that is desirable for a wide range of temperature on the order of −50° C. to +130° C. Furthermore, it is sought to design circuits capable of working in a range of voltage going from less than two volts up to about five volts. It is therefore necessary to be able to work under low voltage (two volts and less) while at the same time providing for voltage stability in this range. Finally, the variations in characteristics due to the manufacturing method must not have any effect on the reference current so as to obtain high reliability in manufacture.

2. Discussion of the Related Art

It has always been difficult to make current reference devices meeting these criteria of stability, especially in logic technologies such as MOS or CMOS technologies because, in principle, there is no known characteristic of a manufacturing process that can be used to obtain current stability of this kind.

The current reference generation devices known in logic technology are mostly based on the Wilson mirror structure. However, the reference current obtained is fairly dependent on the manufacturing method. There is another type of known device described in the patent application FR 95 09023. This device gives a current based on the difference between the threshold voltage $V_{tN}$ of an enhanced transistor and a threshold voltage $V_{tNna}$ of a native transistor having the same type of conductivity. The native transistor drives a reference resistor and the reference current is given by $(V_{tN}-V_{tNna})/R$. This reference current is stabilized by a negative feedback loop formed by the series connection of a P type MOS transistor and an N type MOS transistor that is a native transistor mounted as a diode on the gate of the native transistor which drives the reference transistor. Nevertheless, the use of a negative feedback to obtain stability is not a very satisfactory approach. Furthermore, in this device, the threshold voltage of the native transistor which drives the reference resistor varies with the source-substrate voltage (substrate effect).

In the invention, another structure in integrated circuit form has been found to provide a stable current reference.

An object of the invention therefore is an intrinsically stable current reference device without negative feedback to compensate for one variation or another.

SUMMARY OF THE INVENTION

The invention relates, in one embodiment, to a current reference device in integrated circuit form with a reference resistor. According to the invention, the device comprises a first transistor and a second transistor having the same type of conductivity, the first transistor having its gate and its drain connected together to a first terminal of the resistor, the second transistor having its gate and its drain connected together to a second terminal of the resistor, and the first transistor having a threshold voltage greater than that of the second transistor, these two transistors being biased in saturated mode, the source of each of these transistors being biased at the same potential as the substrate or the well in which the transistor is made.

A reference current is obtained that is intrinsically stable in terms of supply voltage, temperature and method of manufacture. The device may be transposed from one manufacturing technology to another without simulation.

BRIEF DESCRIPTION OF THE DRAWINGS

Other features and advantages of the invention are described in detail in the appended description given by way of an indication that in no way restricts the scope of the invention, and with reference to the appended drawings, wherein:

FIG. 1 shows an embodiment of a current reference device according to the invention, FIG. 2 shows another embodiment of the invention.

DETAILED DESCRIPTION

Figure 3:
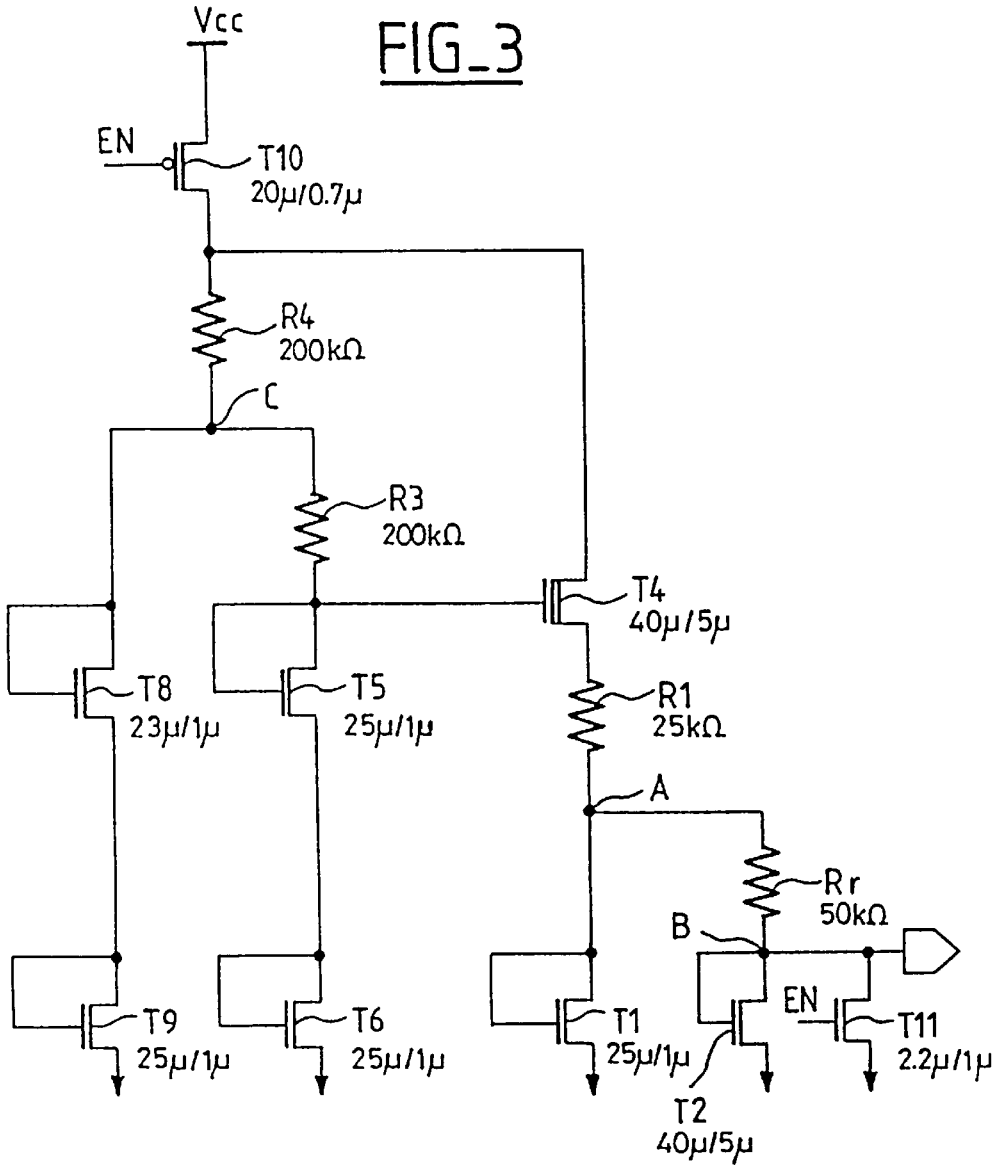
FIG. 3 shows a variant of the device of FIG. 2.

FIG. 1 shows the electronic schematic diagram of a current reference device in integrated circuit form according to the invention.

It comprises chiefly a reference resistor Rr through which the reference current Ir will flow. A first terminal A of this resistor is connected to the drain of a first MOS transistor T1. A second terminal B of the reference resistor is connected to the drain of a second MOS transistor T2. These two transistors each have their gate connected to their drain. And the first transistor T1 has a threshold voltage greater than that of the second transistor T2.

In the example, the transistors T1 and T2 are N type transistors made according to a standard P type substrate technology. The transistor T2 is then a native type of transistor while the transistor T1 is an enhanced type of transistor, in order to fulfil the condition relating to the threshold voltages ($V_{t1}>V_{t2}$). Their sources are then connected to the ground. The P type substrate is then connected to the same potential as the source of the transistors T1 and T2. This eliminates the substrate effect. There is therefore a threshold voltage that is particularly stable with the supply voltage.

A resistor R1 is connected to the drain of the first transistor T1 to draw a charge current I1. This bias resistor R1 may very well be connected directly to the supply voltage Vcc, as shown in dashes in FIG. 1, or else it is possible to provide for a bias circuit CP.

The two transistors T1 and T2 which are mounted as diodes are then in saturated mode and the threshold voltage of the transistor is recovered at their drain. Thus, at the terminals of the reference resistor Rr, there is recovered the voltage $V_{tN}-V_{tNna}$, where $V_{tN}$ is the threshold voltage $V_{t1}$ of the enhanced transistor T1, of the order of 0.8 volts, and $V_{tNna}$ is the threshold voltage $V_{t2}$ of the native transistor T2, which is about 0.2 volts. The reference current Ir is therefore given by the relationship $Ir=(V_{tN}-V_{tNna})/Rr$.

This reference current is independent of the temperature. Indeed, according to the theory and as verified in practice, the threshold voltages of the native transistor and of the enhanced transistor vary in parallel, by two millivolts per degree, so that their difference is practically independent of the temperature. The only possible variation, with temperature, of the reference current obtained by the device of the invention can come from the reference resistor Rr. It could be chosen to make this resistor by so-called drain extension technology. This technology is the one used in low drain doping (LDD) MOS technology, corresponding to a first implantation and low (N−) doped diffusion before highly doped diffusion, to obtain a less sharp junction profile having greater stability under voltage. It is also possible to make the reference resistor by transistor source/drain type diffusion, hence a resistor with higher ($N^+$ or $P^+$) doping that has greater temperature stability.

The variations of the characteristics due to the manufacturing method affect all the threshold voltages as well as the value of the reference resistor. For the difference in the threshold voltages (Vtn−Vtna) of the enhanced N type transistor T1 or of the native N type transistor T2, the variation in method can only come, as regards the manufacturing process used, from the threshold implantation dose of the enhanced transistor T1 since the thickness of the gate oxide is the same for both transistors and since the threshold variation due to the operation for the initial doping of the substrate is seen as much on the native transistor as on the enhanced transistor. This variation can be estimated at ±10%. The variation of the resistance with the method is in the same range. At worst, the variation in the reference current due to the method is thus in the range of ±20% which is satisfactory.

It has been seen that the bias resistor of the device could be connected directly to the supply voltage Vcc. The device then has the advantage of working at very low voltage, since the critical path between the supply voltage and the ground is given by R1, Rr, T2. However, the charge current I1 is then directly dependent on the supply voltage Vcc. If the supply voltage Vcc is made to vary in a range going from 1.6 volts to 6 volts, the charge current of the first transistor will vary greatly, with harmful effects on the stability of the drain voltage of the first transistor and therefore on the reference current.

For this reason, in a first variant shown in FIG. 1, it is planned to use a bias circuit CP that comprises a MOS transistor T3, mounted as a diode, to impose a transistor threshold voltage on the charge resistor R1 that is greater than the threshold voltage of the transistor T1, instead of the supply voltage Vcc. For example, a native P type transistor is chosen to enable the biasing of the enhanced N type transistor T1. The threshold voltage of a native P type transistor (about 1.5 volts) is indeed greater than the threshold voltage of an enhanced N type transistor (about 0.8 volts). However, it is quite possible to choose an N type transistor with greater enhancement than the transistor T1. In the example shown, the P type transistor T3 is biased in saturated mode by means of a resistor R2 connected to the supply voltage Vcc.

There is then a charging current I1 of the transistor T1 that is proportional to the difference between the threshold voltage VtPna of a native P type transistor and the threshold voltage $V_{tN}$ of an enhanced N type transistor: $I1=(V_{tPna}-V_{tN})/R1$. Thus, when Vcc varies, the drain voltage of the transistor T1 undergoes almost no further variation. The reference current $Ir=(V_{tN}-V_{tNna})/Rr$ is then practically independent of the supply voltage Vcc.

By totaling all the variations, namely variations in supply voltage, temperature and method, it has thus been possible, with the values indicated in the drawing of FIG. 1 and the resistors made by drain extension technology, to obtain a reference current that varies in a ratio Imax/Imin smaller than 3.

In practice, it must be noted that the resistor R1 is charged from the resistor R2 and that the reference resistor Rr is charged from the resistor R1. In order that the current may be sufficient to bias the entire device, it is therefore necessary to choose resistors with values such that R2<R1<Rr. And if it is desired to limit the current consumption of the device, it is necessary to have high resistance values. In FIG. 1 therefore, the following values have been chosen: 50 kiloohms for R2, 200 kiloohms for R1 and 500 kiloohms for Rr. With resistance values of this kind, it will be preferable to use the drain extension technology to make resistors, for it is less bulky (2000 ohms/square) than the source-drain technology (which takes up typically 50 to 100 ohms/square in $P^+$, 20 to 50 ohms/square in $N^+$). However, this drain extension technology is less stable in terms of temperature.

Furthermore, if high value resistors are used, the time constant of the device related to the parasitic drain capacitance is increased. Since the current too is weaker, it is also slower to build up. This may be a drawback for certain applications.

FIG. 2 thus shows another electronic schematic diagram of a current reference device in integrated circuit form according to a variant of the invention, enabling the use of resistors with lower values. In this variant, a MOS transistor T4 is used as a follower for the application, to apply to the charging resistor R1, a bias voltage that is independent of the supply voltage. In the example, the MOS transistor T4 is of the N type and is connected between the supply voltage Vcc and the resistor R1. This transistor T4 is controlled at its gate by the voltage dictated by the series assembly of a transistor T5 mounted as a diode in a forward connection (with its gate and drain connected) and a transistor T6 mounted as a diode in a forward connection. These two transistors T5 and T6 are series-connected between the gate of the follower transistor T4 and the ground. The transistor T5 is of the same type as the transistor T4 and has the same threshold voltage (so that these two transistors may compensate for each other as shall be seen). In the example, the transistor T6 is a native P type transistor. It could be an N type transistor. All that is required is that its threshold voltage should be greater than the voltage of the transistor T1. A resistor R3 is provided between the supply voltage Vcc and the transistor T5 to bias the transistors T5 and T6 in saturated mode. Finally, in the example, the N type transistors T4 and T5 are chosen to be native transistors in order to have the lowest possible threshold voltage, enabling the device to work at the lowest supply voltage possible. In this way, the voltage ($V_{tNna}+V_{tPna}-V_{tNna}$), namely $V_{tPna}$, is recovered at the terminal of the charge resistor R1 connected to the transistor T4. The charge current of the transistor T1 is therefore ($V_{tPna}-Vt_{tNna}$)/R1 and is therefore very stable as explained here above.

The value of this variant is that, in the resistor R3, only the current needed to bias the transistors T5 and T6 is consumed, unlike in the diagram of FIG. 1 where the resistor R2 must not only bias the transistor T3 but also supply sufficient current for the bias resistor R1 and the reference resistor Rr. The diagram of FIG. 2 makes it possible in practice to allow greater current consumption in the resistors R1 and Rr, and therefore enables the value of these resistors to be lower. We therefore have a reference current that could be set up more speedily.

Furthermore, if the resistance values are lower, there are fewer problems, as regards space requirement, entailed in a choice to make at least the reference resistor by source/drain technology. The temperature stability of the device is also improved owing to the fact that the resistors have higher doping. The charging resistor R1 could also be made by source/drain diffusion, but this would have less of an effect on stability.

A highly stable device is thus obtained. By contrast, the low voltage operation is downgraded by the follower transistor T4 which adds an additional voltage drop (0.5 volts) in the critical path of the assembly. In practice, it has been ascertained with the values indicated in FIG. 2 and a reference resistor made with a P transistor source/drain type diffusion that the current is stable in a range of voltage going from two volts to 5.5 volts for a temperature varying between −50 and +150° C. Naturally, this second variant works also with high resistance values, but then the same drawbacks (slower response time, greater space requirement) are seen again.

FIG. 3 shows a variant of the device of FIG. 2, enabling a further improvement of the stability of the reference current.

Indeed, in the device of FIG. 2, the resistor R3 is directly supplied by the logic supply voltage of the circuit. If the supply voltage varies, for example if it increases, there is a repercussion on the gate of the follower transistor T4 which will tend to cause an increase in the reference current Ir.

An improvement in the stability of the current may be contributed by the device of FIG. 3.

In this device, a resistor R4 is interposed between the supply voltage Vcc and the terminal C of the resistor R3. And an arm identical to the arm (T5, T6) is provided between the terminal C and the ground, comprising two transistors T8 and T9. The transistor T8 is mounted as a diode and is identical to the transistor T5. The transistor T9 is mounted as a diode and is identical to the transistor T6. In the example, they are all transistors of the same enhanced N type and have the same giometry (W/L). What is important in practice is that, two by two, T5 and T8, T6 and T9, are identical to have the expected compensation.

This arm (T8, T9) is used as a limiter of the voltage at the node C, to make this node less dependent on the variations of the supply voltage Vcc.

Figure 4:
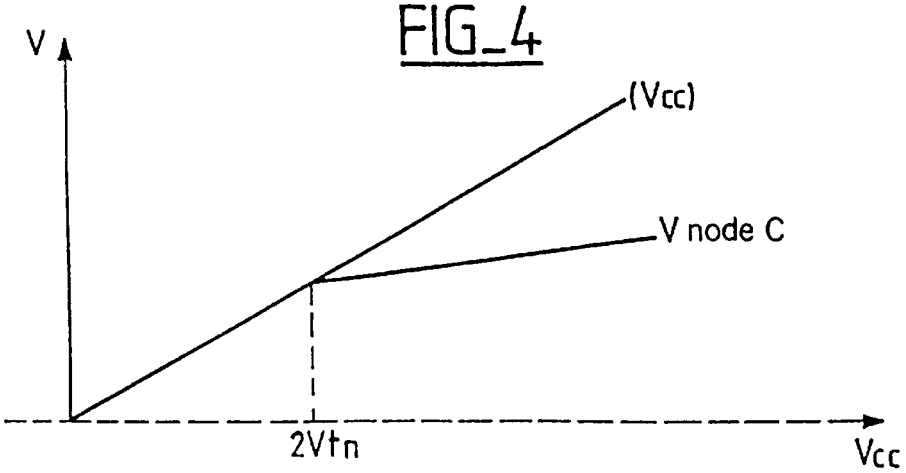
FIG. 4 shows the progress of the voltage at the node C of the device of FIG. 3 as a function of the supply voltage.

When the power is turned on in the device, the node C follows the increase in the supply voltage by means of the resistor R4. But as soon as the node C reaches a potential of the order of 2×Vtn (sum of the threshold voltages of the series-connected transistors T8 and T9), the arm T8, T9 tends to keep this level at the node C: the voltage Vc will then move to a far smaller extent, as shown in FIG. 4. Indeed, T8 and T9 do not have the resistor R3 in their arm. They will let through more current (I) than T5 and T6. Thus, the voltage is this arm given by Vt8+Vt9+Ron.I, where Ron is the equivalent conducting resistance of the two transistors, will be always slightly greater than Vt5+Vt6 (Vti is the threshold voltage of the transistor Ti). This is what makes it possible to have a very low voltage in the resistor R3. Thus, this regulation of the voltage at the node C of the resistor R3 makes it possible to limit the current in the arm (T5, T6). In this way, there is a more efficient regulation of the gate voltage of the follower transistor T4 and of the drain voltage of the transistor T5.

The device shown may very well be made by NMOS technology.

FIG. 3 furthermore shows transistors for turning the power on in the device.

In the example, a P type transistor T10 enables the application or non-application of the supply voltage Vcc to the device (signal EN=0) while an N type transistor T11 sets the output at zero when the device has to be off voltage (signal EN=1). But these devices are not obligatory.

With a device according to any of the variants described here above, a reference current Ir is obtained, from which other reference currents can be obtained by current mirror assemblies. An assembly of this kind is shown for example in FIG. 2: an N type native transistor T7 is mounted in a current mirror assembly in relation to the transistor T2: its gate is controlled by the gate of the transistor T2. Another reference resistor Rr' is connected to the drain of the transistor T7 at one terminal. The other terminal is connected to the supply voltage Vcc. Preferably the same manufacturing technology is used for the reference resistors. A stable reference current Ir' is used. In particular, it has been possible to ascertain, in practice, that the development of the voltage at the drain of the transistor T7 with the supply voltage Vcc is perfectly parallel between 1.6 and 6 volts. For the practical making of the device, it must be noted that preferably a transistor T7 with a long channel is chosen, for example, a transistor T7 with a channel length greater than 5 microns in 1 micron technology, in order to overcome the effects of short channels which adversely affect the current stability in saturated mode (with a long channel, the saturation current no longer depends on the drain/source voltage).

The invention has just been described by choosing transistors with particular types of conductivity. It is possible of course to choose transistors with reverse types of conductivity, provided that the various criteria set out herein are met. The assembly of the diagram can easily be deduced by reversing the types of conductivity and the polarities in the diagrams of FIGS. 1 and 2.

The current reference device in integrated circuit form according to the invention provides great stability. And through its design without negative feedback, it can be transposed from one manufacturing technology to another without simulation. This is not the least of its advantages.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. A current reference device in integrated circuit form with a reference resistor, said device comprising a first MOS transistor and a second MOS transistor having the same type of conductivity, the first transistor having its gate and its drain connected together to a first terminal of the reference resistor, the second transistor having its gate and its drain connected together to a second terminal of the reference resistor, the first transistor having a threshold voltage greater than that of the second transistor and the two transistors being biased in saturated mode, the source of each of these transistors being biased at the same potential as the substrate or the well in which the transistor is made, the reference device further comprising a third MOS transistor with a threshold voltage greater than that of the first transistor and having its gate connected to its drain so as to apply a bias current to the first transistor that is proportional to the difference between the threshold voltages of the first and third transistors by means of a bias resistor connected between the first and third transistors.

2. A current reference device in integrated circuit form with a reference resistor, said device comprising a first MOS transistor and a second MOS transistor having the same type of conductivity, the first transistor having its gate and its drain connected together to a first terminal of the reference resistor, the second transistor having its gate and its drain connected together to a second terminal of the reference resistor, the first transistor having a threshold voltage greater than that of the second transistor and the two transistors being biased in saturated mode, the source of each of these transistors being biased at the same potential as the substrate or the well in which the transistor is made, the reference device also including a bias circuit, wherein the bias circuit comprises a third follower MOS transistor, series connected with a first bias resistor to bias the first transistor, said follower transistor being controlled at its gate by the series connection of a fourth MOS transistor and a fifth MOS transistor, the fourth transistor having the same type of conductivity and the same threshold voltage as the follower transistor and being mounted as a diode, and the fifth MOS transistor having a threshold voltage greater than that of the first transistor and being mounted as a diode, these two transistors being biased in saturated mode, the reference device further having a second bias resistor connected between a drain of the fourth transistor and a supply voltage.

3. A device according to claim 2, wherein a third bias resistor is interposed between the supply voltage and a terminal of the second bias resistor and a sixth transistor and an seventh transistor are series connected between said terminal and ground, the seventh transistor being identical to the fifth one and the sixth transistor being diode connected and identical to the fourth transistor.

4. A device according to claim 1, wherein the reference resistor is made by drain extension type diffusion.

5. A device according to claim 1, wherein the reference resistor is made by source/drain type diffusion.

6. A device according to claim 4, wherein the bias resistor is also made by source/drain type diffusion.

7. A device according to claim 1, further comprising at least one current mirror structure with respect to the second transistor to obtain another reference current in another reference resistor.

8. A device according to claim 7, wherein the other reference resistor is made out of the same technology as the first one.

9. A device according to claim 7, wherein the transistors used in the current mirror structure are transistors with channels sufficiently long so that their saturation currents do not depend on their drain/source voltage.

10. A current reference circuit comprising:

a first control circuit element having first second and third terminals;

a second control circuit element having first, second and third terminals, said first and second control circuit elements being of the same conductivity type;

a reference resistance having first and second terminals, wherein said first and second terminals of said first control circuit element are connected together and to the first terminal of said reference resistance;

said first and second terminals of said second control circuit element are connected together and to the second terminal of said reference resistance;

said first control circuit element has a threshold voltage greater than that of said second circuit control element;

both said first and second control circuit elements are biased in the saturated mode;

the third terminals of the first and second control circuit elements are biased to the same potential;

said first control circuit element comprises a first MOS transistor;

said second control circuit element comprises a second MOS transistor;

said first and second terminals of said first and second transistors comprise a gate and a drain;

the third terminal of the first and second transistors comprise a source;

the reference circuit comprises a third circuit control element and a bias resistor; and said bias resistor couples between said third control circuit element and said first control circuit element.

11. A current reference circuit according to claim 10 wherein said third control circuit element comprises a third MOS transistor.

12. A current reference circuit according to claim 11 wherein said third MOS transistor and said bias resistor apply a bias current to the first MOS transistor that is proportional to the difference between the threshold voltages of the first and second transistors.

13. A current reference circuit comprising:

a first control circuit element having first, second and third terminals;

a second control circuit element having first, second and third terminals, said first and second control circuit elements being of the same conductivity type;

a reference resistance having first and second terminals, wherein said first and second terminals of said first control circuit element are connected together and to the first terminal of said reference resistance;

said first and second terminals of said second control circuit element are connected together and to the second terminal of said reference resistance;

said first control circuit element has a threshold voltage greater than that of said second circuit control element;

both said first and second control circuit elements are biased in the saturated mode;

the third terminals of the first and second control circuit elements are biased to the same potential;

a bias circuit is coupled to said first and second control circuit elements; and the bias circuit comprises a further control circuit element including a follower MOS transistor and a bias resistor, both series-connected to said first control circuit element.

14. A current reference circuit comprising:

a first control circuit element having first, second and third terminals;

a second control circuit element having first, second and third terminals, said first and second control circuit elements being of the same conductivity type;

a reference resistance having first and second terminals, wherein said first and second terminals of said first control circuit element are connected together and to the first terminal of said reference resistance;

said first and second terminals of said second control circuit element are connected together and to the second terminal of said reference resistance;

said first control circuit element has a threshold voltage greater than that of said second circuit control element;

both said first and second control circuit elements are biased in the saturated mode;

the third terminals of the first and second control circuit elements are biased to the same potential;

a bias circuit is coupled to said first and second control circuit elements;

said first control circuit element comprises a first transistor; and the bias circuit comprises a third follower MOS transistor and a bias resistor series-connected with said follower transistor.

15. A reference circuit according to claim 14 including a fourth MOS transistor and a fifth MOS transistor, said follower transistor being controlled by the series connection of said fourth and fifth MOS transistors.

16. A current reference circuit according to claim 15 wherein said fourth transistor has the same conductivity type and the same threshold voltage as the follower transistor and being connected as a diode.

17. A current reference circuit according to claim 16 wherein the fifth MOS transistor has a threshold voltage greater than that of the first transistor and being mounted as a diode.

18. A current reference circuit according to claim 17 wherein said fourth and fifth MOS transistors are biased in the saturated mode and further including a third resistor coupled from said fourth transistor to a supply potential.

19. A current reference circuit according to claim 18 including a further bias resistor coupled in series with said third resistor.

20. A current reference circuit according to claim 19 including sixth and seventh transistors series connected between said third resistor and ground, said sixth transistor being substantially identical to said fourth transistor and the seventh transistor being diode connected and substantially identical to the fifth transistor.

21. A current reference circuit according to claim 10, wherein the reference resistance is made by drain extension type diffusion.

22. A current reference circuit according to claim 10, wherein the reference resistance is made by source/drain type diffusion.

23. A current reference circuit according to claim 13, wherein the bias resistor is also made by source/drain type diffusion.

24. A current reference circuit according to claim 10, further comprising at least one current mirror structure with respect to the second transistor to obtain another reference current in another reference resistance.

25. A current reference according to claim 24, wherein the other reference resistance is made out of the same technology as the first one.

26. A current reference circuit according to claim 24, wherein the transistors used in the current mirror structure are transistors with channels sufficiently long so that their saturation currents no longer depend on their drain/source voltage.

27. A current reference device in integrated circuit form, comprising:

a first transistor means having first, second and third terminals;

a second transistor means having first, second and third terminals;

said first and second transistor means being of the same conductivity type;

a reference resistor means having first and second terminals;

means coupling the first and second terminals of said first transistor means together and to the first terminal of the reference resistance means;

means coupling the first and second terminal of said second transistor means together and to the second terminal of the reference resistance means;

said first transistor means having a threshold voltage greater than that of the second transistor means;

means for biasing both said first and second transistor means into the saturated mode including means for biasing the third terminals of both the first and second transistor means to the same potential;

wherein said first transistor means comprises a first MOS transistor;

said second transistor means comprises a second MOS transistor;

said first and second terminals of said first and second transistors comprise a gate and a drain;

the third terminal of the first and second transistors comprise a source;

the current reference device comprises a third transistor means and a bias resistor, and said bias resistor couples between said third transistor means and said first transistor means.

28. A current reference circuit according to claim 27 wherein said third transistor means comprises a third MOS transistor.

29. A current reference circuit according to claim 28 wherein said third MOS transistor and said bias resistor apply a bias current to the first MOS transistor that is proportional to the difference between the threshold voltages of the first and second transistors.

30. A current reference circuit according to claim 27 including a bias circuit coupled to said first and second transistor means.

31. A current reference circuit according to claim 30 wherein the bias circuit comprises a follower MOS transistor and the bias resistor, both series-connected to said first transistor means.

32. A current reference circuit according to claim 30 wherein said first transistor means comprises a first transistor.

33. A current reference device in integrated circuit form, comprising:

a first transistor means having first, second and third terminals;

a second transistor means having first, second and third terminals;

said first and second transistor means being of the same conductivity type;

a reference resistor means having first and second terminals;

means coupling the first and second terminals of said first transistor means together and to the first terminal of the reference resistance means;

means coupling the first and second terminal of said second transistor means together and to the second terminal of the reference resistance means;

said first transistor means having a threshold voltage greater than that of the second transistor means;

means for biasing both said first and second transistor means into the saturated mode including means for biasing the third terminals of both the first and second transistor means to the same potential;

a bias circuit coupled to said first and second transistor means, wherein said first transistor means comprises a first transistor; and the bias circuit comprises a third follower MOS transistor and a bias resistor series-connected with said follower transistor.

34. A current reference circuit according to claim 33 including a fourth MOS transistor and a fifth MOS transistor, said follower transistor being controlled by the series connection of said fourth and fifth MOS transistors.

35. A current reference circuit according to claim 34 wherein said fourth transistor has the same conductivity type and the same threshold voltage as the follower transistor and being connected as a diode.

36. A current reference circuit according to claim 35 wherein the fifth MOS transistor has a threshold voltage greater than that of the first transistor and being mounted as a diode.

37. A current reference circuit according to claim 36 wherein said fourth and fifth MOS transistors are biased in the saturated mode and further including a third resistor coupled from said fourth transistor to a supply potential.

38. A current reference circuit according to claim 37 including a further bias resistor coupled with said third resistor.

39. A current reference circuit according to claim 38 including sixth and seventh transistors series connected between said third resistor and ground, said sixth transistor being substantially identical to said fourth transistor and the seventh transistor being diode connected and substantially identical to the fifth transistor.

40. A current reference circuit according to claim 27, wherein the reference resistor is made by drain extension type diffusion.

41. A current reference circuit according to claim 27, wherein the reference resistor is made by source/drain type diffusion.

42. A current reference circuit according to claim 30, wherein the bias resistor is also made by source/drain type diffusion.

43. A current reference circuit according to claim 27, further comprising at least one current mirror structure with respect to the second transistor to obtain another reference current in another reference resistor.

44. A current reference circuit according to claim 43, wherein the other reference resistor is made out of the same technology as the first one.

45. A current reference circuit according to claim 43, wherein the transistors used in the current mirror are transistors with channels sufficiently long so that their saturation currents no longer depend on their drain/source voltage.

* * * * *